US006133907A

United States Patent [19]

Liu

[11] Patent Number: 6,133,907

[45] Date of Patent: Oct. 17, 2000

[54] POINTING DEVICE HAVING A MOTION PICTURE PROJECTED THEREFROM

[76] Inventor: Chi-Hsing Liu, No. 17, Alley 46, Lane 484, Sec. 2, Feng-Shih Rd., Fengyuan City, Taichung Hsien, Taiwan

[21] Appl. No.: 09/123,666

[22] Filed: Jul. 28, 1998

[51] Int. Cl.[7] ..... G09G 5/04

[52] U.S. Cl. ..... 345/183; 345/180; 345/182; 345/31; 362/118

[58] Field of Search ..... 345/31, 156, 180, 345/182, 183; 324/752; 372/24; 430/945; 348/132; 396/155; 362/118

[56] References Cited

U.S. PATENT DOCUMENTS

| | | | |
|---|---|---|---|
| 4,241,343 | 12/1980 | Fan et al. | 345/31 |
| 4,310,857 | 1/1982 | Lieber et al. | 3/217 |
| 4,470,044 | 9/1984 | Bell | 345/31 |
| 5,307,253 | 4/1994 | Jehn | 362/259 |
| 5,343,376 | 8/1994 | Huang | 362/259 |
| 5,400,132 | 3/1995 | Trepagnier | 356/138 |
| 5,617,304 | 4/1997 | Huang | 362/118 |
| 5,663,828 | 9/1997 | Knowles et al. | 359/237 |
| 5,903,224 | 5/1999 | Reynolds | 340/815.45 |
| 5,951,149 | 9/1999 | Lee | 362/259 |
| 5,988,832 | 11/1999 | Chen | 362/259 |
| 5,993,026 | 11/1999 | Wu | 362/259 |

*Primary Examiner*—Richard A. Hjerpe
*Assistant Examiner*—Henry N. Tran
*Attorney, Agent, or Firm*—Thomas, Kayden, Horstemeyer & Risley LLP

[57] ABSTRACT

A pointing device includes a casing having a lens received in the first end thereof and a battery received in the second end thereof. A motor is received in the casing and has a shaft to which a transparent disk is co-rotatably mounted, a plurality of pictures imprinted on the transparent disk. A control device for actuating the motor is received in the casing and connected to a button on the casing. A laser beam generating device is located between the control device and the transparent disk, and aligns with the pictures when the transparent disk is co-rotated with the shaft so as to project a motion picture on a remote wall.

3 Claims, 5 Drawing Sheets

POINTING DEVICE HAVING A MOTION PICTURE PROJECTED THEREFROM

FIELD OF THE INVENTION

The present invention relates to a pointing device, and more particularly, to a pointing device employing a laser beam emitting means and a rotationing film, wherein a motion picture is formed when the laser beam passes through the rotationing film.

BACKGROUND OF THE INVENTION

The conventional pointing device generally forms a spot on a remote wall so that when the user moves the pointing device, the spot is moved accordingly. However, the spot is so small that people can hardly find it if the spot is projected on a color chart, and the spot tends to blend with the background. In order to overcome this disadvantage, a film having a picture, such as an arrow head, imprinted thereon is installed in front of the laser beam emitting means so that the arrow head will be shown on the remote wall when the laser beam passes through the film. The film can only provide a fixed picture so that it is boring in some situations such as if most of the audience are children or a reporting procedure using the pointing device concerns interesting subjects. After all, the purpose of the pointing device is to attract the audience's attention.

The present invention intends to provide a pointing device having a motion picture projected therefrom so as to attract people's attention and the motion picture will not blend with the background so that the disadvantages of the conventional pointing device can be obviated.

SUMMARY OF THE INVENTION

In accordance with one aspect of the present invention, a pointing device is provided and comprises a casing having a first end thereof with a lens connected thereto and a second end thereof having a battery chamber defined therein, an opening defined through the peripheral wall of the casing. A motor is received in the casing and has a shaft extending therefrom to which a transparent disk is co-rotatably mounted to the shaft and has a plurality of pictures imprinted thereon.

A control means for actuating the motor is received in the casing and connected to a button which extends through the opening. A laser beam generating means is located between the control means and the transparent disk, and aligns with the pictures when the transparent disk is co-rotated with the shaft.

An object of the present invention is to provide a pointing device which projects a motion picture on a remote wall.

Further objects, advantages, and features of the present invention will become apparent from the following detailed description with appropriate reference to the accompanying drawings.

DETAILED DESCRIPTION OF THE PREFERRED EMBODIMENT

Figure 1:
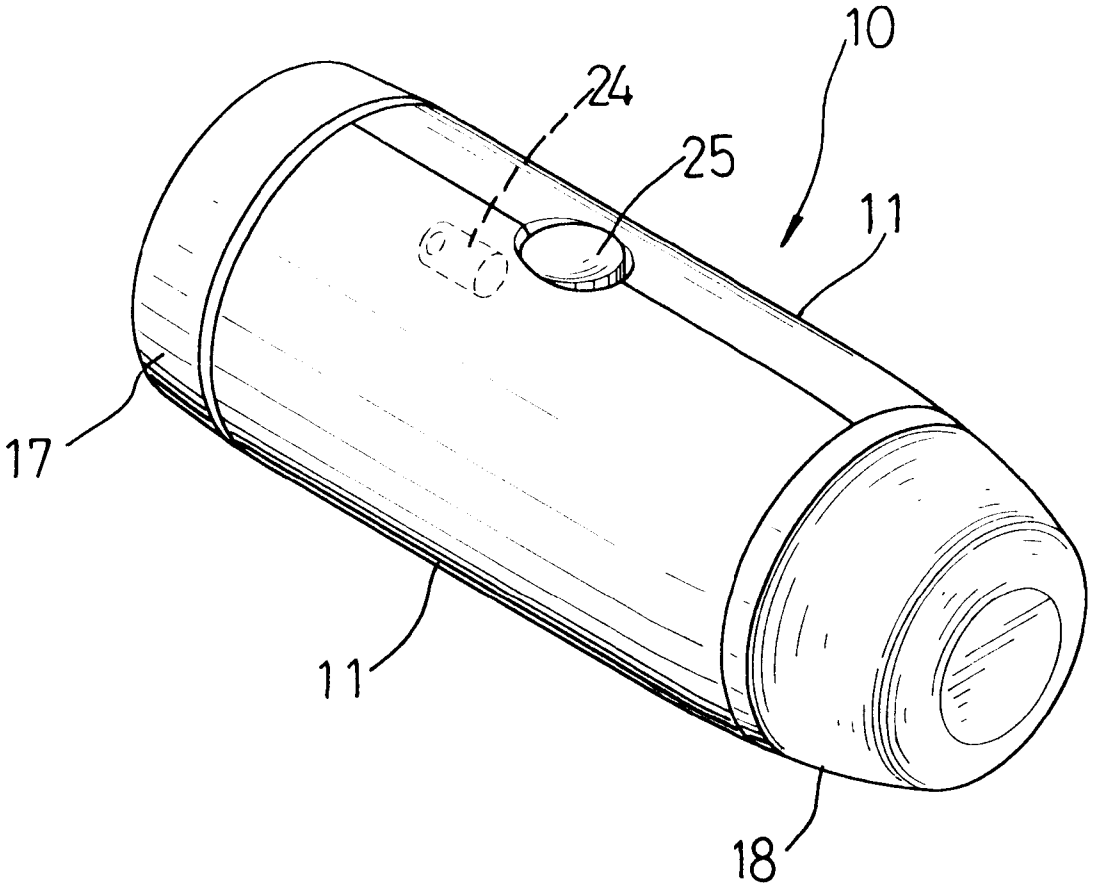
FIG. 1 is a perspective view of a pointing device in accordance with the present invention.
Figure 2:
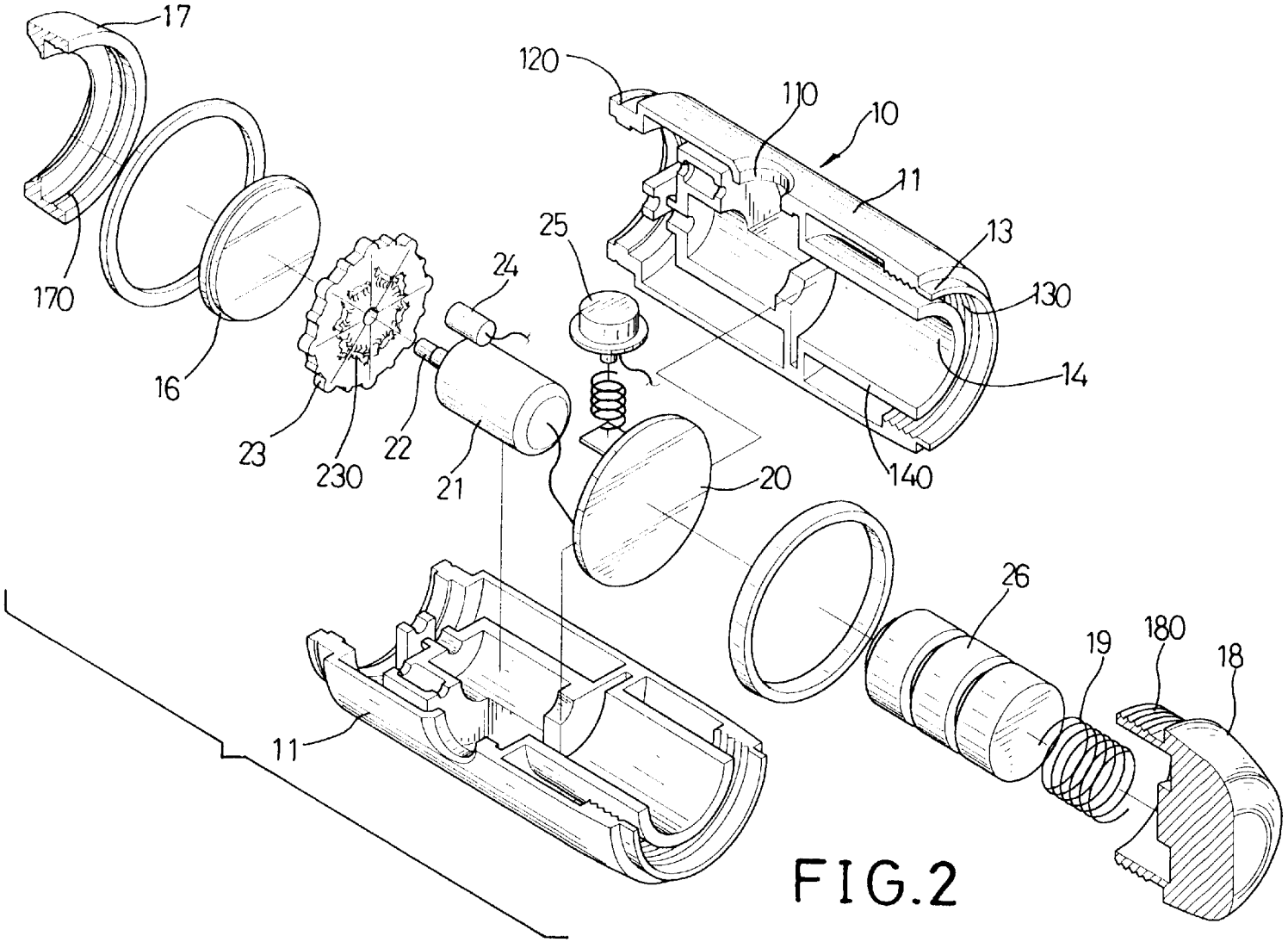
FIG. 2 is an exploded view of the pointing device in accordance with the present invention.
Figure 3:
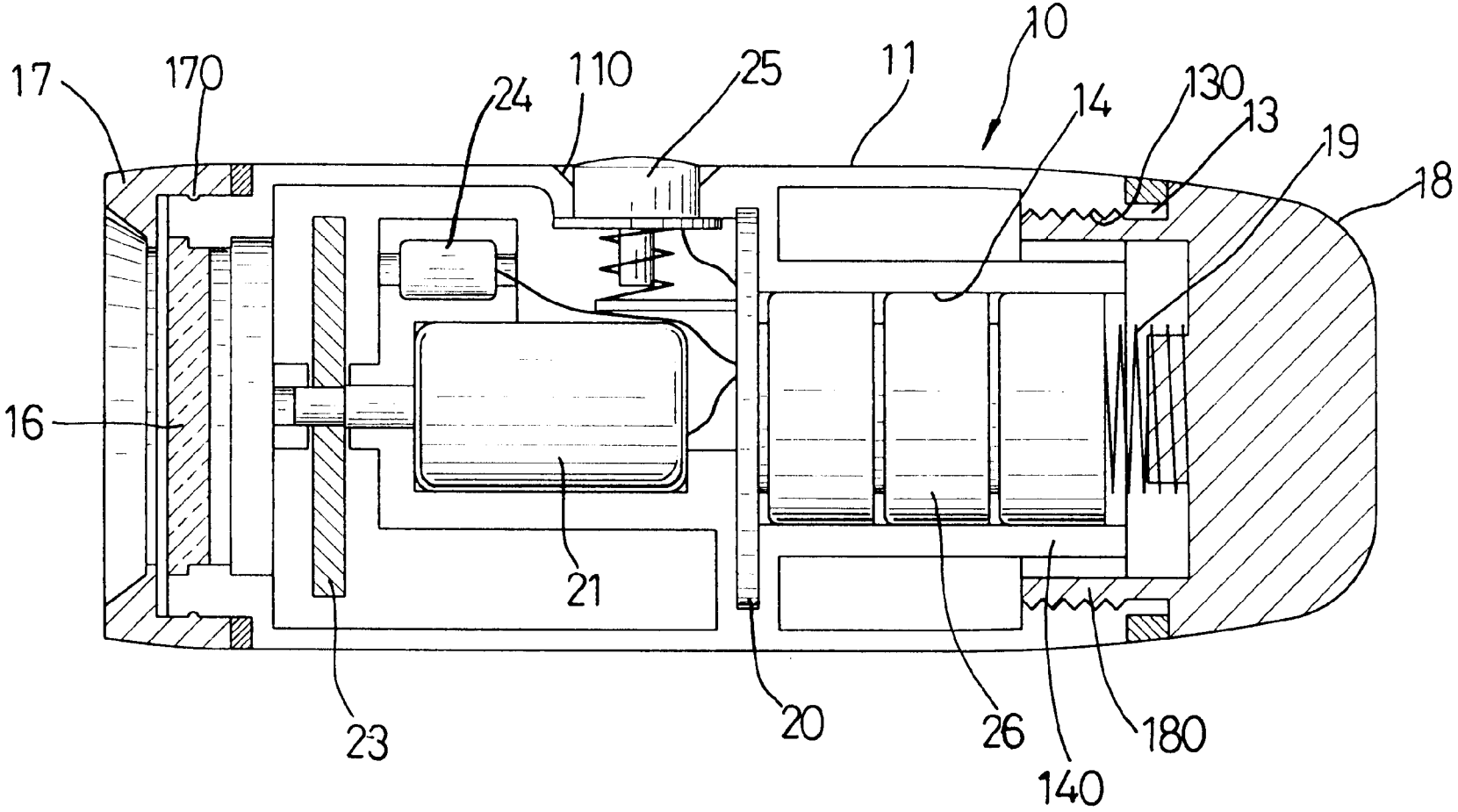
FIG. 3 is a side elevational view, partly in section, of the pointing device in accordance with the present invention.

Referring to FIGS. 1 through 3, a pointing device comprises a casing 10 composed of two parts 11 and having a first end thereof having a lens 16 received therein and a second end thereof having a battery chamber 14 defined therein with a cap 18 mounted thereto. An opening 110 is defined through the peripheral wall of the casing 10 so as to receive a button 25 therein. The battery chamber 14 is defined by an inner tube 140 in the casing 10 so as to receive the batteries 26 therein and an annular gap is defined between the peripheral wall of the casing 10 and the inner tube 140. A threaded portion 130 is defined in the inner periphery of the peripheral wall of the casing 10 and the cap 18 has an insertion 180 which is threadedly engaged with the threaded portion 130 of the casing 10 with a spring 19 received between the batteries 26 and the cap 18 so as to press the batteries 26 toward the first end of the casing 10.

A stepping motor 21 is received in the casing 10 and has a shaft 22 extending therefrom to which a disk 23 is co-rotatably mounted. The disk 23 is a transparent member and has a plurality of pictures 230 marked thereon which are continuous and individual steps of a motion picture 30 such as a running horse shown in FIG. 5. A control means 20, such as an integrated circuit board, for actuating the motor 21 is received in the casing 10 and connected to the button 25 which extends through the opening 110 so that the stepping motor 21 is actuated when the button 25 is pushed. A laser beam generating means 24 is located between the control means 20 and the disk 23, and aligns with the pictures 230 when the disk 23 is co-rotated with the shaft 22 so that when the disk 23 is rotated with the shaft 22 when the stepping motor 21 is actuated, the laser beam from the laser beam generating means 24 passes through each of the pictures 230 in sequence so that a continuous motion picture 30 can be formed.

The first end of the casing 10 has a groove 120 defined in the outer periphery thereof and a collar 17 is mounted to the first end of the casing 10 with a flange 170 extending radially and inwardly therefrom so as to be received in the groove 120.

Figure 4:
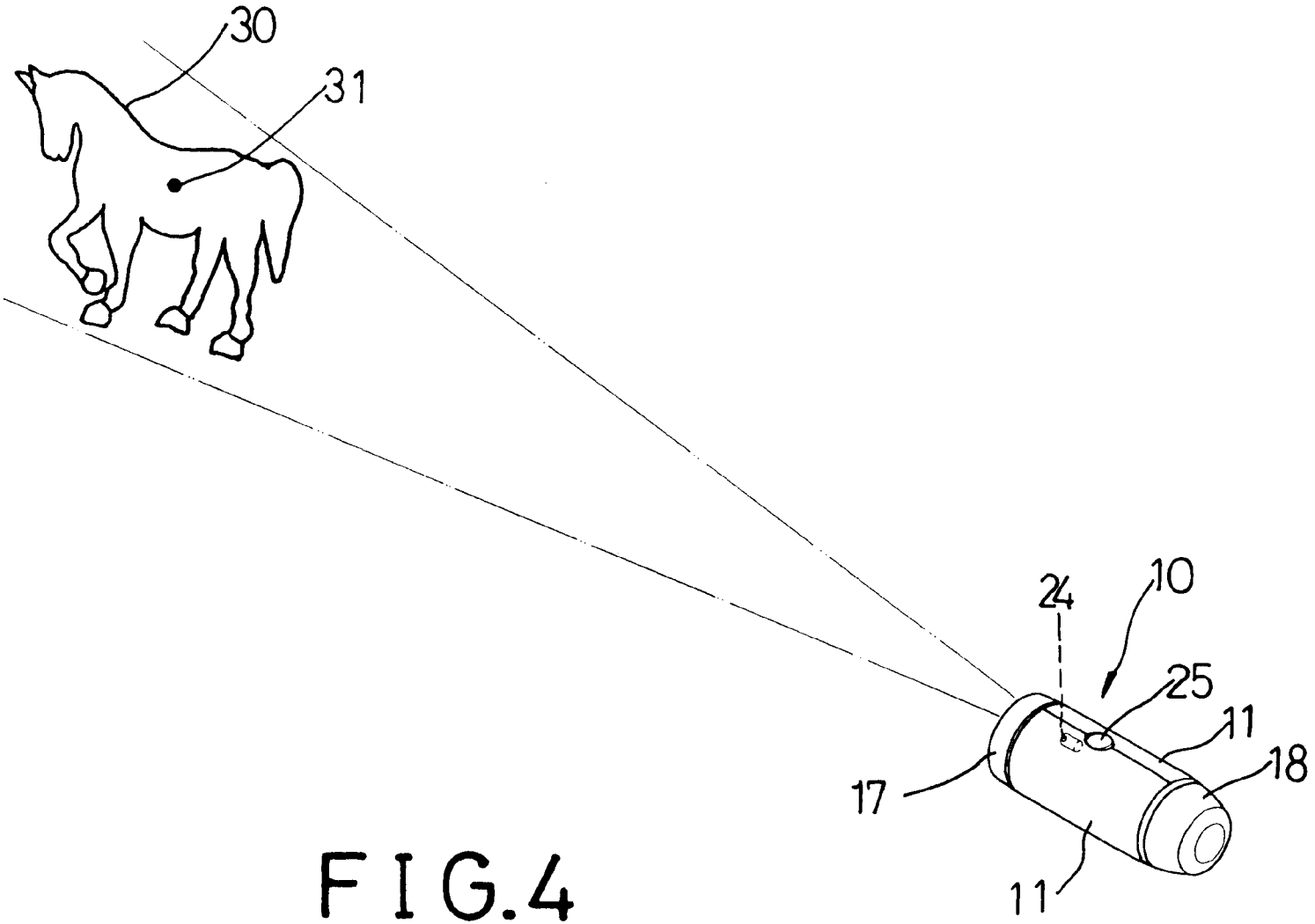
FIG. 4 is an illustrative view to illustrate the picture projected by the pointing device.
Figure 5:
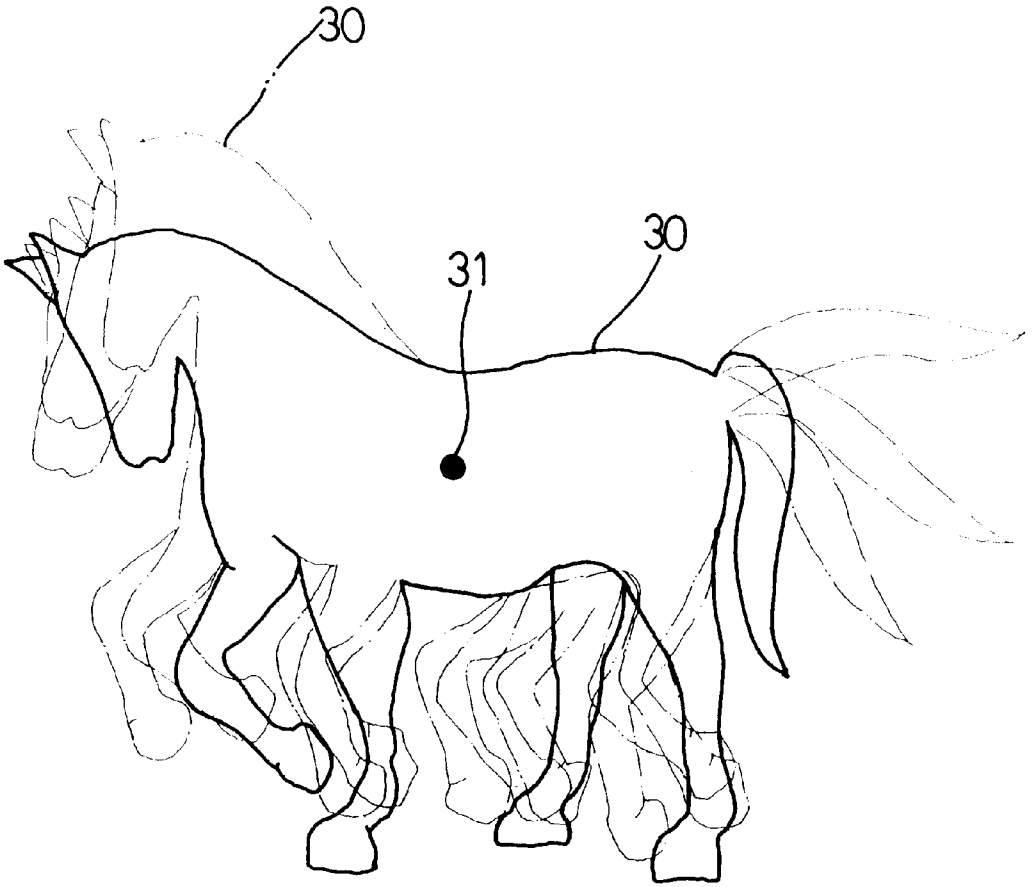
FIG. 5 is an illustrative view to illustrate the motion picture projected by the pointing device.

Further referring to FIGS. 4 and 5, the pictures on a remote wall form a motion picture because the laser beam passes through the pictures 230 which forms the motion picture 30, a spot 31 is formed in the center of the motion picture 30, where the laser beam is concentrated. Accordingly, the motion pictures 30 will attract people's attention and will not be confused with the background.

Although the invention has been explained in relation to its preferred embodiment, it is to be understood that many other possible modifications and variations can be made without departing from the spirit and scope of the invention as hereinafter claimed.

What is claimed is:

1. A pointing device comprising:

a casing having a first end thereof having a lens connected thereto and a second end thereof having a battery chamber defined therein, an opening defined through the peripheral wall of said casing;

a motor received in said casing and having a shaft extending therefrom, a transparent disk co-rotatably mounted to said shaft and having a plurality of pictures imprinted thereon;

a control means for actuating said motor being received in said casing and connected to a button which extends through said opening, and a laser beam generating means located between said control means and said transparent disk, and aligning with said pictures when said transparent disk is co-rotated with said shaft.

2. The pointing device as claimed in claim 1, wherein said battery chamber is defined by an inner tube in said casing and an annular gap is defined between said peripheral wall of said casing and said inner tube, a threaded portion defined in the inner periphery of said peripheral wall of said casing, a cap having an insertion which is threadedly engaged with said threaded portion of said casing.

3. The pointing device as claimed in claim 1 further comprising a collar mounted to said first end of said casing, said collar having a flange extending radially and inwardly therefrom and said first end of said casing having a groove defined in the outer periphery thereof so as to receive said flange.

* * * * *